United States Patent [19]

Hopman

[11] 4,366,657

[45] Jan. 4, 1983

[54] METHOD AND FORM FOR MECHANICALLY POURING ADOBE STRUCTURES

[76] Inventor: Fred Hopman, Box 171, Arroyo Seco, N. Mex. 87514

[21] Appl. No.: 127,487

[22] Filed: Mar. 5, 1980

[51] Int. Cl.[3] ..... E04B 2/00

[52] U.S. Cl. ..... 52/405; 52/426; 52/741; 249/34

[58] Field of Search ..... 52/405, 425, 427, 741, 52/297, 426; 249/13, 18, 33, 34

[56] References Cited

U.S. PATENT DOCUMENTS

| | | | |
|---|---|---|---|
| 1,530,662 | 3/1925 | Gibbons et al. | 52/743 |
| 2,595,123 | 4/1952 | Callan | 52/741 |
| 2,625,729 | 1/1953 | Ingalls | 52/426 X |
| 2,827,736 | 3/1958 | Estey | 52/297 X |
| 3,555,751 | 1/1971 | Thorgusen | 52/426 X |
| 3,559,355 | 2/1971 | Day, Jr. | 52/378 X |
| 3,574,981 | 4/1971 | Henschen | 52/741 X |
| 4,161,852 | 7/1979 | Schultz | 52/741 X |

*Primary Examiner*—John E. Murtagh
*Assistant Examiner*—Carl D. Friedman
*Attorney, Agent, or Firm*—Cushman, Darby & Cushman

[57] ABSTRACT

A method of forming and pouring an adobe structure including floor, ceiling and wall, and forms for constructing walls, in which two layers of wire mesh are stretched between guide supports that are inserted into a foundation at the inside and outside of the foundation. The mesh is supported by vertical mesh supports, horizontal mesh supports, cross ties and diagonal ties. Adobe is poured between the two layers of mesh. Rigid insulation can be placed between the mesh prior to the adobe pour. The mesh can be left in place and cement plastered, or it can be removed and reused. The adobe for floors, ceilings and walls can be mixed, transported and deposited mechanically. Adhesives, fibers and curing agents can be added to the adobe mix.

43 Claims, 13 Drawing Figures

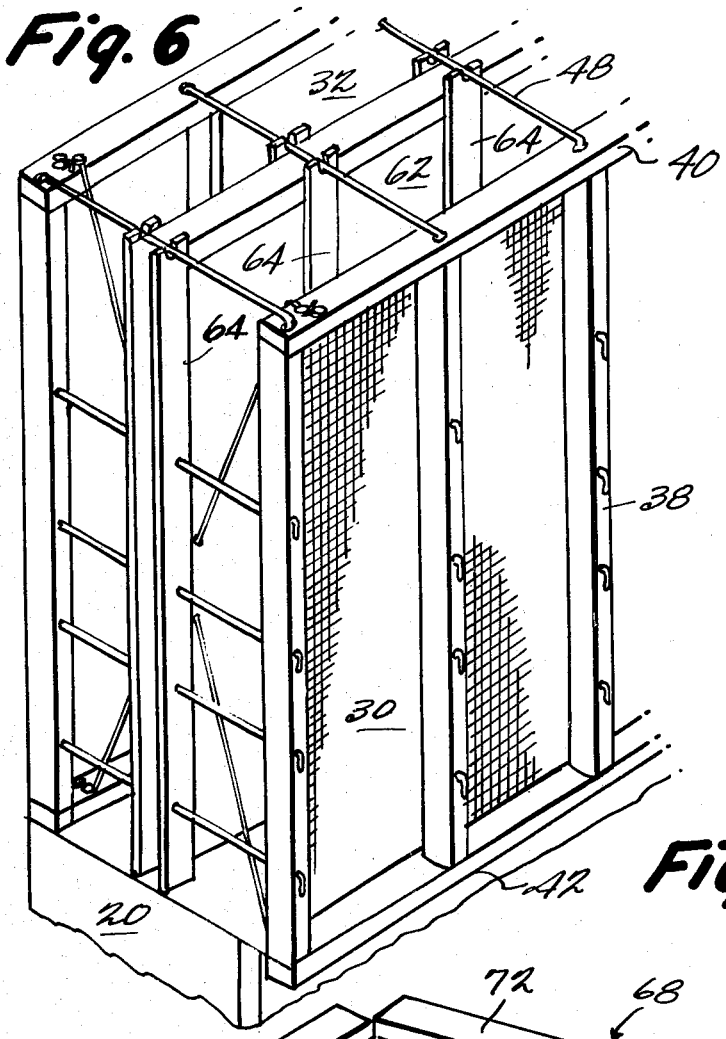
Fig. 6
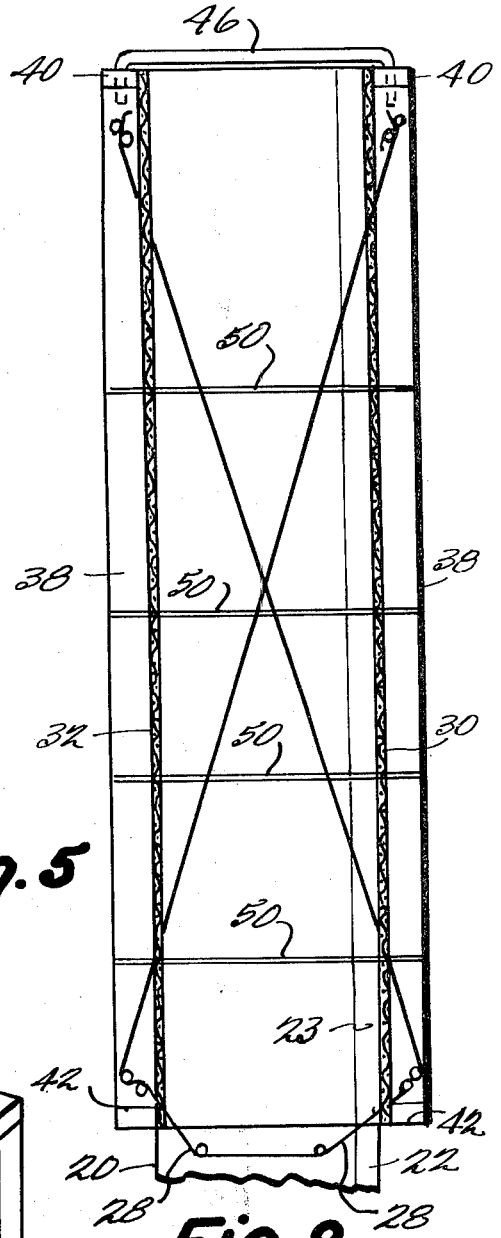
Fig. 5
Fig. 8
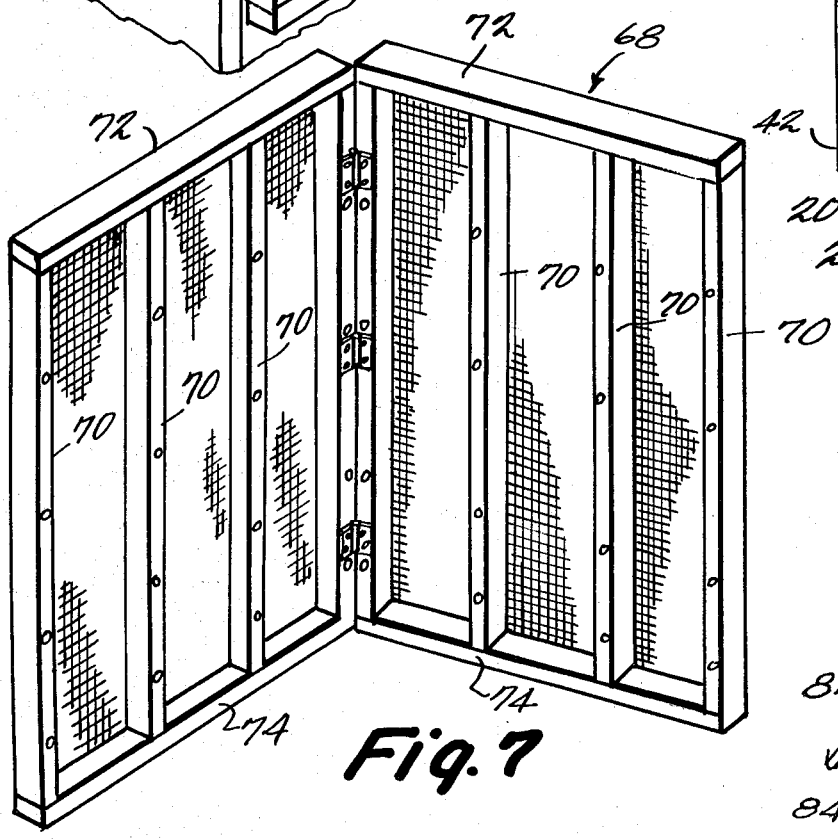
Fig. 7
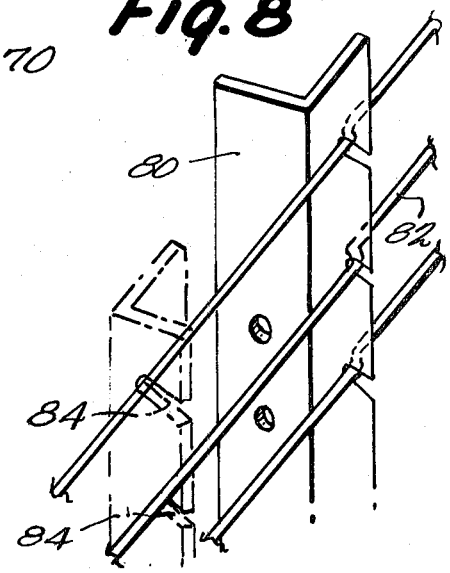

Fig. 9
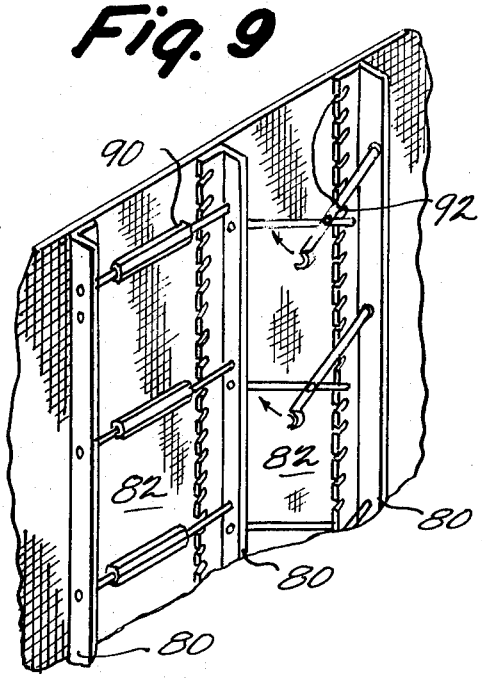
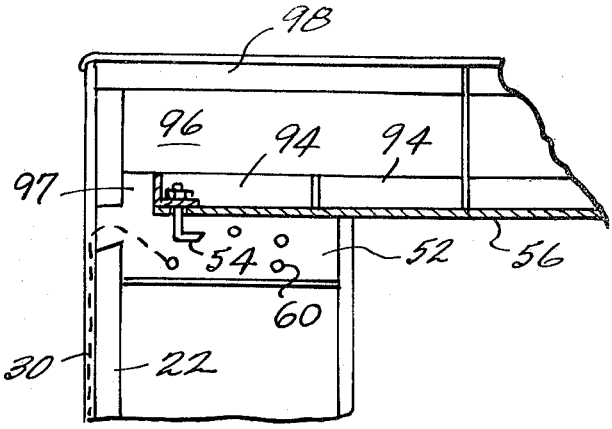
Fig. 10
Fig. 11
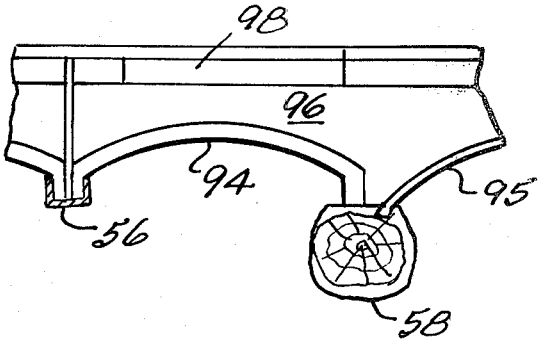
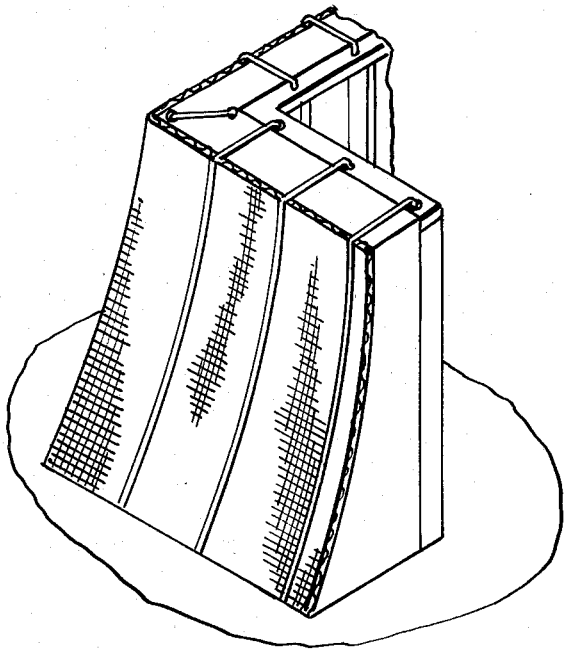
Fig. 12
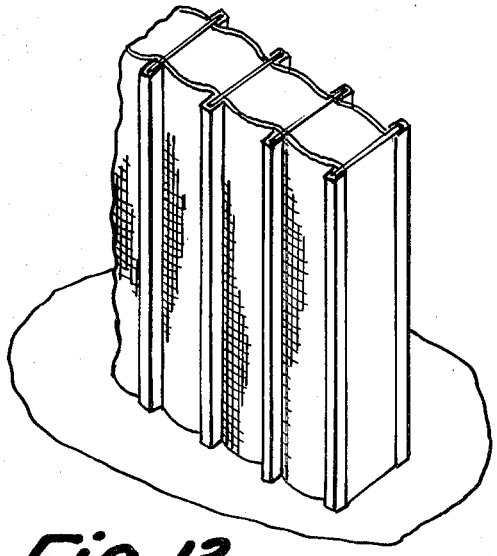
Fig. 13

METHOD AND FORM FOR MECHANICALLY POURING ADOBE STRUCTURES

The invention relates to a method and form for making an adobe structure.

ADVANTAGES AND DISADVANTAGES OF CONVENTIONAL ADOBE CONSTRUCTION

Adobe has been used as a building material for milennia throughout the world. Probably the first adobe application was "puddled adobe," a process in which wet adobe mud was piled on a wall and left to set up; then the process was repeated. The advantage here was that the adobe was moved only two times: from the ground to the mixing pit and onto the wall. The disadvantage was that, unlike cement which sets up with a chemical bond, the adobe had to dry out to solidify. The drying process was unduly slow. The first innovation in adobe construction was to make bricks and build them up with adobe mortar as a bonding agent. There is evidence that adobe bricks were used in ancient Egypt and by way of the Arabs and the Spaniards, came to the New World.

Modern adobe construction has remained virtually unchanged since Egyptian times. One characteristic of traditional adobe structures is that they need to be plastered with a fresh coat of adobe and straw plaster every few years. A modern invention is to either add stabilizing and waterproofing agents to the bricks and the plaster, or to add an exterior cement or stucco plaster to the building.

There are several advantages to adobe as a construction material, that will become more important as conventional energy becomes scarcer. First, adobe has good thermal mass properties. That is to say, it can store heat, or lack of heat in accordance with its specific heat. Thus it can perform the function of a heat sink to store solar heat for use during cloudy days or at night. In a massive Russian fireplace, for instance, adobe can absorb heat from a central firebox and release it slowly over a period of several days. In hot climates or seasons, the heat sink properties of adobe in a structure maintain coolness as the adobe absorbs heat during the day and releases it at night. This "fly-wheel" effect is crucial for any solar house and greatly benefits any energy-conserving design.

Another characteristic from an energy standpoint is that adobe requires virtually no energy to produce, even if mixed and poured mechanically. It is also usually locally available in unlimited quantities. If incorporated into a passive solar house, the thermal design of the house will assure and encourage the drying and curing of the adobe to its full strength.

Other advantages of adobe as a building material are: (1) Durability; the oldest historical houses in the United States are of adobe construction. The Pre-Colombian Taos Pueblo, a five-story adobe structure built without any cement, stabilizers or waterproofing agents, is estimated by archaeologists to be at least 900 years old. (2) Versatility; the flowing forms of southwest architecture with their arches and sculpted fireplaces attest to the versatility of adobe. It is easy to shape, mold and carve. (3) Cost; the cost of the raw material; clay and aggregate, found in most earth, is literally "dirt cheap." The present high price of adobe construction is attributed to time-consuming labor. (4) Ecological viability; adobe is a friendly, non-toxic material to work with and to live in. A major ecological advantage is that it is a 100% "biodegradable," simply melting back into the ground when a house is torn down or abandoned. (5) Nuclear shield; one foot of earth is recommended over a fall-out shelter to protect from nuclear radiation. Massive adobe construction is equivalent to building a fall-out shelter aboveground. (6) Understandability; finally, a major advantage of adobe is that it is uncomplicated and within the range of any builder's comprehension.

There are several disadvantages to conventional adobe construction that have limited its range of acceptability. First, in construction with adobe brick, the adobe is moved, on the average, seven times before it is in place in the wall: from the ground to the mixing pit; to the wheelbarrow; then to the adobe brick mould frames. The frames are removed and the wet bricks left to dry for a few days. The bricks are then lifted on edge to dry the underside. After two weeks (depending on the weather) they are stacked into a drying stack. They are then brought to the construction site and stacked. Finally, they are lifted onto the wall, and set into mortar. The mortar, which constitutes about 1/5 of the final wall is usually hand mixed on the construction site. This time-consuming method brings the cost of conventional adobe construction above cement block or stud frame construction.

Two characteristics of conventional adobe are climate dependent: (a) the drying of the bricks and of the freshly masoned wall requires dry weather; (b) adobe, even when cured, is vulnerable to water erosion. A climate with high annular rainfall would not be suited for conventional adobe.

Adobe is often considered a "primitive" building material and is associated with developing countries or regions. Uninformed people often have a hard time reconciling the stereotype of "mud huts" with the elegant building material that adobe often is. Thus even though it has proven its durability and cost-effectiveness in many areas of the country, it is banned or inhibited by severe building codes and narrow-mindedness.

The relatively recent innovation of cement-plastering the exterior of adobe buildings has unexpected disadvantages: adobe and concrete don't have the same coefficient of expansion. This encourages the propensity of the thin layer of concrete to develop cracks. If cracks let in sufficient rainwater, the interior above can again revert to mud and simply melt away, leaving a deceptively structural looking shell of concrete.

Even though adobe has good thermal mass properties, its insulation value, with an R factor of 0.23 is very poor. A foot of adobe has roughly the same insulation value as an inch of polystyrene. To attach insulation to the outside of an existing adobe wall with enough rigidity to accept an exterior cement plaster coat, creates major anchoring problems.

All these disadvantages of conventional adobe are addressed with the present invention, without jeopardizing the aforementioned advantages.

BACKGROUND

Several prior attempts at pouring adobe into forms have been made, all with limited success. One method used in the southwest around the turn of the century when wood boards became available, was to construct a loose lattice or board framework, and pour the adobe into it. The problems here were that the exterior adobe plaster did not adhere well to the wood and required constant maintenance. The wood eventually rotted away, leaving unsupported sections of adobe wall.

Newer attempts have concentrated on moveable frame moulds that could be placed *on* the wall being built, filled with adobe and then pulled off and placed on the wall again to be refilled. The concept has produced successful walls, but the following limitations have prevented wide acceptance: (a) generally only one course can be poured a day since the wet adobe must dry out to become rigid; (b) the forms are usually placed and filled manually. Loading the adobe mechanically would not be cost-effective in this case because of the long curing time.

Concrete forming procedures have been tried for adobe, but found to be non-functional since the adobe does not set up chemically, but requires air to dry and thereby harden. Molds, some of which are for concrete, are described in U.S. Pat. Nos. 1,173,880; 1,667,253; 1,667,253; 1,963,981; 2,313,880; 1,607,114 and 840,672.

BRIEF DESCRIPTION OF THE INVENTION

In spite of the disadvantages of traditional adobe construction which haven't changed for thousands of years, adobe is gaining popularity in the southwest by means of its virtues. The present invention eliminates the disadvantages of traditional adobe, namely: high cost, excessive construction time, poor insulation value, climatic limitations and improper plastering procedures. At the same time it retains the advantages of traditional adobe. Much of the usual expense of constructing thermal mass walls for solar structures is avoided through an innovative procedure of pouring adobe mud mechanically or manually into mesh forms to provide a monolithic, structurally continuous mass of adobe; in effect one giant brick. Shrinking and cracking is minimized by correct clay-to-aggregate ratios and fiber admixtures. The forms are made by inserting vertical guide supports into sleeves or holes in the separated locations along the inside and outside of the foundation. A suitably strong mesh with horizontal strands is then connected to the guide supports either by stretching mesh and mounting mesh supports exterior to the mesh or by using frames with prestretched mesh. The mesh and/or the mesh supports are anchored to the foundation.

Using mesh permits the uninterrupted mechanical pouring of an entire one-story wall section at the same time. Since the mesh is pourous, the adobe dries satisfactorily. The mesh is structural, supporting the wall during drying. Using horizontal strands is necessary to provide lateral tensile strength.

A continuous wall height can be poured at once, resulting in a high-grade, hydraulically pressurized adobe that is structurally continuous. Pouring preferably continues until the wall is completed without drying of any portions thereof before completion of pouring. The adobe is preferably mixed and transported mechanically. Rigid insulation can be incorporated in the wall or adjacent the exterior wall prior to the pour. The forms are reusable. The mesh can either be used as a reinforcing for stucco or plaster finishes or can be removed and reused. An adobe floor can be mixed, transported and deposited mechanically. Adobe wall plaster can be mixed and deposited mechanically. The walls, the wall plaster and the adobe floor can contain admixtures of adhesive, waterproofing, and hardeners to reinforce and strengthen the adobe, and both the latter can be finish trowelled manually.

The ceiling and roof can be made entirely—or if desired, almost entirely—without wood. Stabilized adobe for the ceiling-roof can be mixed and deposited mechanically. The walls, the ceiling and the floor can perform as thermal mass to store heat.

The primary advantages of the design and procedure are: There is minimal energy used in the building materials; there is minimal wood used in the construction; the design is considered for optimal solar heating and cooling; construction time and costs are kept at a minimum; adobe has been proven to be extremely durable; the present adobe pour system can be used in a much wider climatic range than conventional adobe, and finally, adobe is environmentally sound and biodegradable. The present system is expected to overcome institutional barriers that have limited the use of conventional adobe.

The present invention finds particular utility in creation of a low-cost solar heated and cooled adobe house construction method. Thus the basic principles of passive solar design can be taken into account in the construction process: (1) Adequate insulation can be provided *exterior* to the house's thermal mass; (2) The exterior of the foundation of the house can be insulated to about 2 feet below grade to (a) prevent frost heaving of the foundation and (b) prevent heat loss from the floor of the house. The ground below the house can thereby also become a heat sink for thermal storage. (3) Sufficient thermal mass can be provided interior to the insulation to store adequate heat, or lack of it, for the calculated solar heating or cooling fraction (% heat from the sun vs. conventional backup heat or % nightime cooling vs. backup cooling) in any given climate. (4) Sufficient south facing (north facing in the southern hemisphere) glass or glazing material to accept a calculated amount of solar energy is included. Immediately interior of the glass there can be a thermal storage adobe Trombe Wall. (5) This glazing is protected with an overhang from the summer solar input. (6) East and west walls have smaller window areas to protect from summer heat input and winter heat loss.

BRIEF DESCRIPTION OF THE DRAWINGS

FIG. 5 shows a sectional view along the lines 5—5 of FIG. 2 illustrating forms of the present invention and the connection between the mesh supports and the anchors in the foundation;

FIG. 6 shows a perspective view of a first modification of the embodiment of FIGS. 1-5 in which a rigid sheet of insulation is mounted in the middle of the form;

FIG. 7 shows a second modification of the invention in which the mesh is pre-stretched and attached to the mesh supports;

FIG. 8 shows a third modification in which the vertical mesh supports attach to the horizontal strands of mesh;

FIG. 9 shows a perspective view of the arrangement of FIG. 8 showing horizontal mesh supports which can expand laterally to stretch the mesh;

FIG. 10 shows a side view illustrating the formation of a ceiling-roof on the walls;

FIG. 11 shows an alternative arrangement for forming a ceiling-roof;

FIG. 12 shows a perspective view of an adobe wall in which the thickness decreases with height;

FIG. 13 shows a perspective view of an adobe wall in which a pillar effect is achieved by incomplete stretching of the mesh.

DETAILED DESCRIPTION OF THE DRAWINGS

Figure 1:
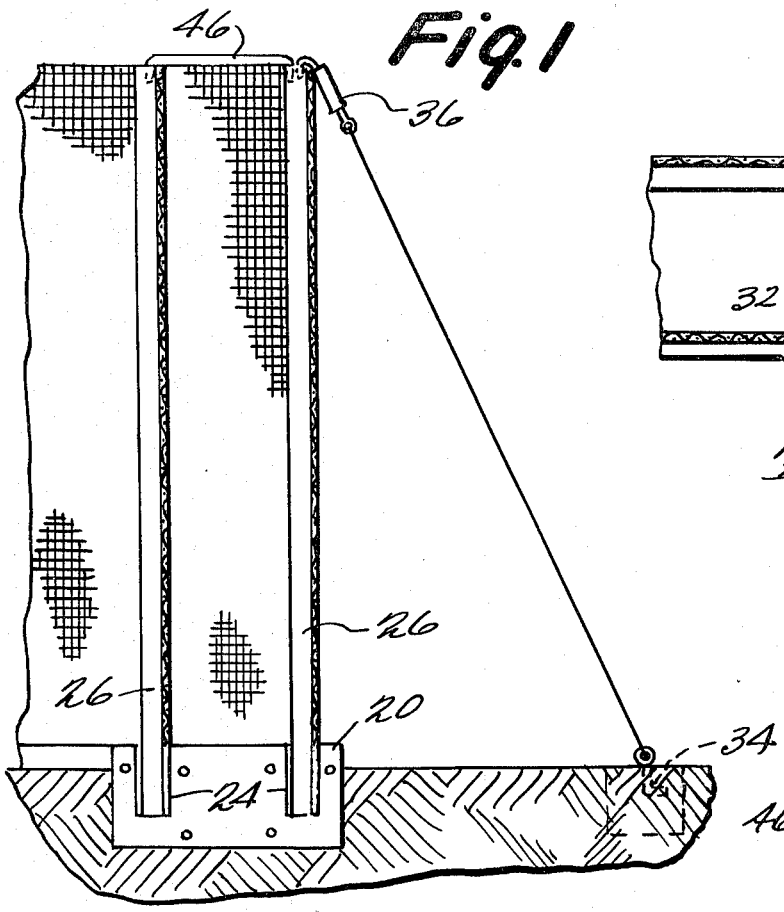
FIG. 1 shows a view of the corner vertical guide supports of the present invention in place on a foundation, and is a sectional view along the lines 1—1 of FIG. 2.
Figure 2:
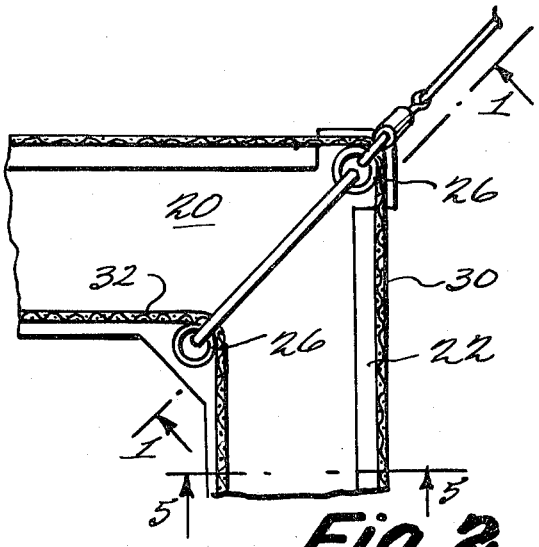
FIG. 2 shows a top plan view of a foundation corner as in FIG. 1.
Figure 3:
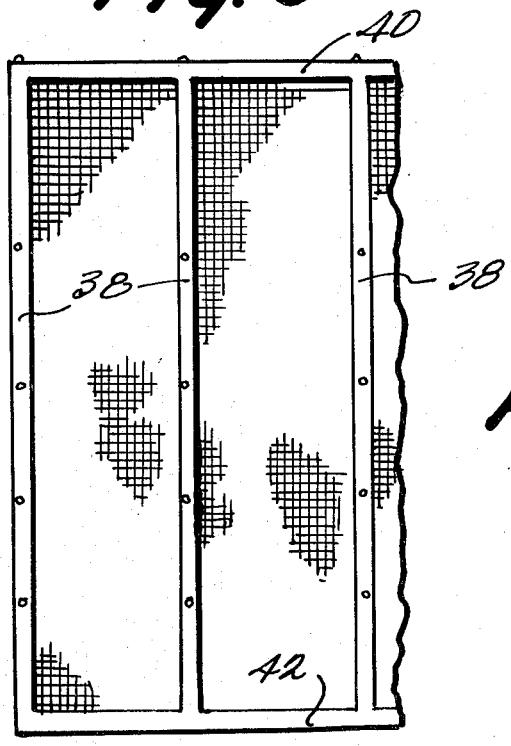
FIG. 3 shows a partial front view of a form from the exterior.

Reference is now made to FIGS. 1-5 which illustrate a first embodiment of the present invention. A conventional concrete foundation 20 is poured to extend slightly above the ground level, although in some locations the foundation can be poured directly on the ground. If warranted by the climate, the foundation 20 is insulated on the exterior with a sheet of rigid insulation 22, for example, styrafoam, as shown in FIG. 5. A vapor barrier such as a sheet of flexible plastic can be placed on the inside of insulation 23, particularly in moist climates. To secure the forms to the foundation, two types of hardware are inserted into foundation 20. The first is a plurality of tubes or sleeves 24 of any suitable shape inserted at separated locations along both the interior and exterior of the foundation. Mating vertical guide supports 26 are then inserted into these sleeves or tubes. The second hardware utilized are a plurality of wire, wire mesh hooks, buckles or connectors 28 (FIG. 5) which can be attached to the forms as described below. Plumbing and electric lines can also be incorporated into, or through the foundations, and the doorframes are set in place.

Flexible but non-stretching wire mesh screen of any suitable material, for example, metal mesh, a few inches higher than the height of the desired walls is now unrolled around the inserted vertical guide supports 26, on both the interior (32) and exterior (30) of the foundation to form continuous mesh screens 32 and 30. The mesh has horizontal strands and may be interwoven vertical, diagonal and horizontal strands. The vertical guide supports 26 are guy-wired at anchor points 34 in the ground a distance away from the foundation. Conventional turn-buckles 36 can be utilized to adjust the tension of the guy-wires. The wire mesh 30 and 32 is then stretched successively until all sections are stretched to the desired tension. The amount of tension determines the bulginess of the walls to be formed.

Figure 4:
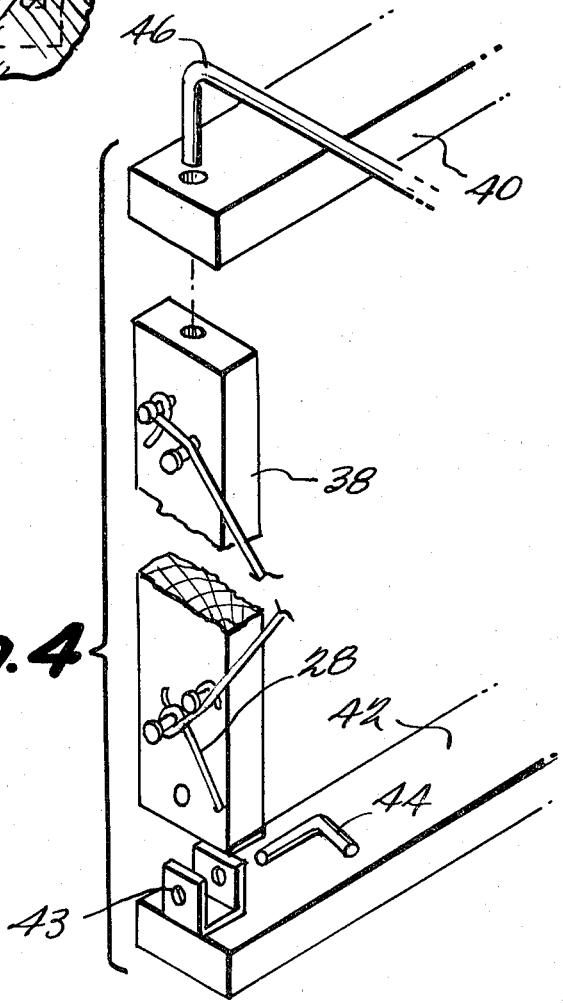
FIG. 4 shows an exploded view of the vertical and horizontal mesh supports, and the connections therebetween.

The wire mesh is next fitted with a series of vertical mesh supports 38 which are attached at the respective top and bottoms thereof to horizontal top support 40 and bottom support 42, as shown in FIG. 4. Each mesh support 38 is received in a bracket 43 on lower horizontal support 40 and held in place by pin 44 which passes through a hole in vertical support member 38 and matching holes in bracket 43. A U-shaped cross-tie 46 extends through a hole in top support 40 and a matching hole in vertical mesh support 38 (FIG. 4). Cross-tie 46, as can be seen in FIG. 5, also holds together the respective mesh supports on the inside and outside of the foundation. Rigid insulation 23 is placed vertically interior to the exterior mesh 30 (FIG. 5). Cross-ties 50, which are not U-shaped, extend between vertical mesh supports 38 as shown in FIG. 5 and are bolted or otherwise fastened in place.

Diagonal wires are attached between the bottom of each vertical mesh support 38 and the top of the mesh support 38 on the opposite side. The verticle mesh supports 38 are also connected to the connectors 28 mounted in the foundation. One such type of connector, shown in FIGS. 4 and 5 is a length of wire, 28 partially buried in the foundation, that wraps around pins, hooks or nails in vertical mesh support 38. After the form is in place plumbing and electric lines can be incorporated into the wall-to-be. Cross-ties are omitted where window frames are to be added.

Adobe of the correct clay to aggregate ratio is then brought on site and placed in accessible piles. A ratio of clay to aggregate of 10-20% has been found to be stable and structural, while causing minimal shrinkage. The adobe may be soaked with water prior to the mixing procedure or during the procedure. The adode is mixed mechanically with a cement truck, backhoe or by any other method. Alternatively, the adobe can be mixed manually and manually put into the form. Additives can be included in the adobe mix such as adhesives, stabilizers, fibers or water-proofing agents. Straw and asphalt emulsion are two such admixtures.

The adode is now poured into the wire mesh form preferably mechanically by the use of a backhoe, cement pump, sluice or conveyor belt. The entire wall height can be poured at one time or pouring can be done in sections to allow lower layers to set up prior to further pouring. Once the height of the bottom of the windows is reached, the windows are lowered into place either mechanically or manually. The pour is terminated ten inches or so from the top of the wire mesh and the adobe then left to cure for two to four weeks, during which times other aspects of the construction can be completed. When cured the wall is a monolithic structurally continuous mass. When the entire height is poured at one time, the wall may be described as being integrated.

In fact, for all purposes in this document, including claim interpretation, the term "integrated wall" is defined as a wall whose entire height is poured at one time.

A reinforced concrete beam 52, for example 6 inches thick, can now be poured across the entire top of the adobe wall as shown in FIG. 10. The bond beam 52 extends out over any rigid insulation to insure that no water from roof leaks can enter the adobe wall. The top edge of the exterior wire mesh 30 is poured into the bond beam 52 or is secured to bond beam 52 by other means. Thus, exterior mesh 30 is secured adequately to receive coats of cement plaster, and remains in place within the adode wall. Into the bond beam 52 can be placed anchor bolts 54 or other means of securing the roof supports 56 and 58. Suitable rebars 60 can be included within bond beam 52.

All structural supports and cross-ties can now be removed for reuse. The interior wire mesh 32 may also be removed for reuse and some of the cross-ties used to pull rods or wires through the wall to further anchor exterior wire mesh 30 to the adode wall. Other forms of anchoring the mesh to the adode may be used. The exterior and interior wall surfaces now can be plastered or finished as desired.

Reference is now made to FIG. 6 which illustrates a modification of the embodiment of FIGS. 1-5. In this embodiment, a rigid sheet of insulation 62, for example, styrofoam, is placed vertically in the middle of the wall and mounted by a plurality of vertically extending brackets 64 or a series of short "H"-shaped brackets. With this arrangement the adode can dry from both wall surfaces and the exterior layer does not function as a thermal mass but rather as a superior surface to apply a finish coat of adobe plaster, stabilized adode plaster or cement plaster. Also, in this arrangement, both interior and exterior layers of mesh can be retrieved for reuse.

FIG. 7 illustrates a modification of the invention in which the mesh 66 is prestretched on a wooden or other frame 68 comprising a plurality of vertical mesh supports 70 and upper and lower supports 72 and 74 respectively. The frames 68 can be connected sequentially to make up any length of wall and can be either connected in a straight line or at any desired angle. Frames 68 are connected to vertical guide supports 26. Frames on the exterior and interior of the foundation are connected to each other as described above.

FIGS. 8 and 9 show a further modification of the invention in which the vertical mesh supports 80 attach to the horizontal wires of the mesh screen 82. The individual supports 80 are placed upon the mesh screen by engaging the horizontal strands with downward facing slots 84 and rotated from the position shown in dashed lines to attach firmly to the mesh screen. As shown in FIG. 9, compression turnbuckles 90, or snap buckles 92 or any suitable structure is used for laterally stretching screen 82 into its final position. Two vertical supports 80 are hooked into mesh 82 and the mesh between the two supports is stretched; then a vertical support is hooked at the appropriate distance from either of the previously placed supports and the wire in between is stretched. This is continued around both layers of mesh and the frames are then cross-tied across the wall to be.

There are several factors that can increase the structural integrity of poured adobe walls in earthquake prone areas. First, the design of the forms can include a post-and-lintel structure that is structurally sound regardless of the adode. Vertical posts of wood or metal can substitute for the vertical guide supports 26 described in the basic procedure. The posts are tied to the foundation by means of anchor bolts or spikes protruding from the foundation or are mated with sleeves in the foundation. The wire mesh can be stretched to the posts and secured with fence staples or equivalent means, or the mesh can be stretched around the posts, as in the basic procedure. Lintels or beams running horizontally are added after the pour. If building code requirements allow, the bond beam substitutes for the lintel, and is tied securely to the vertical post. Cement-filled pipe may be used for the posts. Stabilizers, such as asphalt emulsion cement or white glue, and fiber, such as straw, can be added for further strength. Thicker walls add strength since the thicker the wall, the more stable it becomes. The wire mesh can be left in place on both sides of the wall and plastered over with an appropriately strong plaster. Reinforcing, such as metal lath, can be included in the adode pour.

One of the substantial advantages of the present technique is that an eleqant durable and inexpensive adobe floor can be easily poured. After leveling the ground, and covering it with a moisture barrier, adobe can be applied in one or two layers. Mechanically pouring the adobe floor using a backhoe is one efficient approach.

If the ceiling is to have thermal mass to perform as a heat storage device, then either conventional flat slabs of concrete or arched reinforced concrete slabs 94 can be used for the ceiling structure as shown in FIG. 11. These concrete arches can be achieved with a continuous pour directly on the roof supports 56 or 58 using arched masonite 95 as forms on which to pour. Stabilized adobe can be poured directly over arched masonite to form a structurally sound ceiling. If a ceiling without wood is preferred, the roof supports can be "U"-shaped beams 56 or simply strap iron (not shown). These roof supports must be securely anchored to the previously poured bond beam 52 by means of anchor bolts 54 previously mentioned. The resulting structure is tension-compression with the roof supports being the tension member and the upper arched part of the slabs the compression members. Wood can also be used as roof supports. The space 97 exterior to the end brace is filled with concrete and the arches or slabs are overlayed by several inches of stabilized adobe 96 which can be poured mechanically or manually and troweled out smooth on top. The adobe is overlayed by rigid insulation 98 which is anchored to the adobe and the roof supports. The rigid insulation can be adhered to the adobe with a layer of hot tar or equivalent adhesive.

This design has several advantages over conventional wood ceilings. It eliminates part or all of the need for wood which is becoming a scarce commodity, particularly in the arid areas of the world where adobe is most applicable. Also, it increases the amount of interior thermal mass in a strategic location. Since the hottest air in a room is close to the ceiling the thermal mass of the ceiling is constantly being heated from below. The mass then radiates its heat to cooler surfaces in the rooms. The arched effect of the ceiling increases the interior surface area making the mass more accessible for heat storage. The cost of the ceiling is minimal.

FIGS. 12 and 13 show two of a possible number of variations for the shape of the wall. Since adobe as a construction material is extremely cheap it can be used for massive architectural elegant design. Walls that are wider at the base than at the top as shown in FIG. 12 can be achieved using the basic forming procedure discussed above but varying the length of the cross-ties. If vertical curves are preferred then flexible vertical supports are employed. To achieve a pillared effect as shown in FIG. 13 the mesh is simply left loose rather than stretched.

Other structural and functional features can also be poured with adobe by using exterior wire mesh for forms and other suitable forms. Such items include but are not limited to bancos (adobe benches), fireplaces, arches, closets and bookshelves set into the wall prior to the pour, stairs and garden walls.

Many changes and modifications in the above-described embodiment of the invention can, of course, be carried out without departing from the scope thereof. Accordingly, that scope is intended to be limited only by the scope of the appended claims.

What is claimed is:

1. A method of forming an adobe structure including a wall comprising the steps of:

laying a foundation;

inserting a plurality of guide supports into said foundation at separated locations on the inside and outside of said foundation so that said supports extend vertically;

placing mesh having at least horizontally extending strands between said supports on both the inside and outside of said foundation; and pouring adobe into the space between said mesh to form said wall using only the mesh as a form on at least one of the inside and outside of said foundation.

2. A method as in claim 1, wherein said step of placing includes stretching said mesh between adjacent supports to a desired tension.

3. A method as in claim 1, wherein said step of pouring includes mechanically pouring said adobe.

4. A method as in claim 1 including the further step of mechanically mixing said adobe.

5. A method as in claim 1 or 4 including the further step of mechanically transporting said adobe from the place of mixing to the place of pouring.

6. A method as in claim 1 or 4 including plastering the inside of said wall with adobe plaster and mechanically mixing and transporting said plaster to said wall.

7. A method as in claim 1 or 4 including admixing additives with said adobe to reinforce and strengthen said adobe.

8. A method as in claim 1 or 4 including placing a vapor barrier on the outside of said wall.

9. A method as in claim 1 including the step of placing insulation interior to the exterior layer of mesh before pouring.

10. A method as in claim 1, wherein said step of inserting includes placing a plurality of sleeves in said foundation and inserting one of said supports in each of said sleeves.

11. A method as in claim 1, wherein said mesh has horizontal and vertical strands.

12. A method as in claim 1 including connecting said vertical guide supports on the outside of said foundation to anchor points oautside said foundation.

13. A method as in claim 1 including the further steps of placing door and window frames between said mesh.

14. A method as in claim 1 including the further step of mechanically placing window frames between said mesh when said wall has been poured to the height of the desired height of said windows.

15. A method as in claim 1 including the further step of mechanically pouring an adobe floor.

16. A method as in claim 1 including the step of placing a rigid sheet of insulation vertically between said mesh on the outside and said mesh on the inside.

17. A method as in claim 16 including the further step of removing said mesh on the inside after setup of the adobe.

18. A method as in claim 1 including the further step of attaching a plurality of vertical mesh supports to said mesh on the inside and outside and connecting each of said vertical mesh supports to adjacent vertical mesh supports by means of laterally expanding structural units to stretch said mesh.

19. A method as in claim 1 including the steps of forming a plurality of walls enclosing a space, pouring a concrete beam atop each of said walls, anchoring roof supports on said beams, providing concrete slabs on said supports, and placing adobe atop said slabs.

20. A method as in claim 1 including the steps of forming a plurality of walls enclosing a space, pouring a concrete beam atop each of said walls, providing a plurality of roof supports atop said beams, providing curved support sheets atop said roof supports, placing stabilized adobe atop said sheets to form said roof and perform as thermal mass for the building.

21. A method as in claim 19 or 20 including the further steps of overlaying said adobe with insulation.

22. A method as in claim 1, 19 or 20 including the further step of mechanically forming an adobe floor.

23. A method of forming an adobe structure including a wall comprising the steps of:

laying a foundation;

inserting a plurality of connectors in said foundation;

inserting a plurality of guide supports into said foundation at separated locations on the inside and outside of said foundation so that said supports extend vertically;

placing mesh having at least horizontally extending strands between said supports on both the inside and outside of said foundation;

attaching horizontal frame supports to the top and bottom of each of a plurality of vertical mesh frame supports to form a mesh support frame exterior to said mesh;

attaching said vertical frame mesh supports to said connectors;

trying at least some of said vertical mesh frame supports on the interior of said foundation to a vertical mesh frame support on the exterior of said foundation; and pouring adobe into the space between said mesh to form said wall.

24. A method as in claim 23 including the further step of removing said supports after the wall has cured.

25. A method as in claims 23 or 24 including the further steps of removing the interior mesh and plastering the exterior mesh.

26. A method as in claim 23 including the further steps of placing a sheet of insulation within the mesh on the outside of said foundation, and pouring a reinforced concrete bond beam across the top of said wall after curing of said adobe to seal said insulation and make the adobe wall structurally integral.

27. A method of forming an adobe structure including a wall comprising the steps of:

laying a foundation;

inserting a plurality of guide supports into said foundation at separated locations on the inside and outside of said foundation so that said supports extend vertically;

placing mesh having at least horizontally extending strands between said supports on both the inside and outside of said foundation; and pouring adobe into the space between said mesh to form said wall, said pouring continuing until said wall is completed, without drying of any portions thereof before completion of pouring.

28. A method of forming an adobe structure including a wall comprising the steps of:

placing mesh having at least horizontally extending strands on the inside and outside of a foundation to extend vertically;

connecting said mesh on the inside to said mesh on the outside; and pouring adobe in the space between said mesh to form said wall using only the mesh as a form on at least one of the inside and outside of a foundation.

29. An adobe wall extending at least one-story in height comprising a solid, monolithic, integrated wall of adobe having a mesh screen having at least horizontally extending strands on the exterior thereof and a layer of plaster covering said screen.

30. A wall as in claim 29, wherein said mesh screen has horizontal and vertical strands.

31. A wall as in claim 29 or 30 including a bond beam of concrete atop said wall of adobe.

32. A wall as in claim 31 wherein said mesh is cast into said beam.

33. An adobe wall form comprising:

a foundation;

a plurality of guide supports removably disposed in said foundation at separated locations on the inside and outside of said foundation;

a pair of mesh screens having at least horizontal strands extending between said supports on the inside and outside of said foundation to form a space between said mesh screens for receiving adobe, said space being completely open except for elements which may be removed after said adobe wall is formed; and mesh support means disposed proximate said pair of mesh screens at intervals therealong for mounting on the inside and outside of said foundation to support said mesh.

34. A form as in claim 33, wherein said mesh support means includes a plurality of connectors inserted into said foundation at separated locations, a plurality of vertical mesh supports, horizontal frame supports connected to said vertical mesh supports at the top and bottom thereof, and means for connecting said supports together and connecting said supports to said connectors in the foundation.

35. A form as in claim 34 including cross ties connecting said vertical mesh supports together.

36. A form as in claim 34, wherein said vertical mesh supports each include downward facing slots for receiving strands of said screens to attach that support to said screen and including expandable horizontal supports between adjacent vertical mesh supports for stretching said mesh.

37. A form as in claim 35 further including a sheet of rigid insulation between said screens and means for mounting said insulation between said screens.

38. A form as in claim 33 including means for anchoring at least some of said guide supports to a location outside said foundation.

39. A form as in claim 33, wherein said screen has horizontal and vertical strands.

40. A method of forming an adobe structure including a wall comprising the steps of:

laying a foundation;

inserting a plurality of guide supports into said foundation at separated locations on said foundation so that said supports extend vertically;

placing mesh on both the inside and outside of said foundation;

attaching said mesh to said supports; and pouring adobe into the space between said mesh to form said wall using only the mesh as a form on at least one of the inside and outside of said foundation.

41. A method of forming an adobe structure including a wall comprising the steps of:

laying a foundation;

inserting a plurality of guide supports into said foundation at separated locations on the inside and outside of said foundation so that said supports extend vertically;

placing mesh having at least horizontally extending strands between said supports on both the inside and outside of said foundation;

pouring adobe into the space between said mesh to form said wall;

removing the interior mesh after the wall has cured; and plastering the exterior mesh.

42. A method of forming an adobe structure including a wall comprising the steps of:

laying a foundation;

inserting a plurality of guide supports into said foundation at separated locations on the inside and outside of said foundation so that said supports extend vertically;

placing mesh having at least horizontally extending strands between said supports on both the inside and outside of said foundation;

pouring adobe into the space between said mesh to form said wall; and removing said supports after the wall has cured.

43. An adobe wall form comprising:

a foundation;

a plurality of guide supports removably disposed in said foundation at separated locations on the inside and outside of said foundation;

a pair of mesh screens having at least horizontal strands extending between said supports on the inside and outside of said foundation to form a space for receiving adobe; and mesh support means for mounting on the inside and outside of said foundation to support said mesh, said mesh support means including a plurality of vertical mesh supports, said vertical mesh supports each including downward facing slots receiving strands of said screen to attach that support to said screen and including expandable horizontal supports extending between adjacent vertical mesh supports for stretching said mesh.

* * * * *